US005390919A

United States Patent [19]

Stubbs et al.

[11] Patent Number: 5,390,919

[45] Date of Patent: Feb. 21, 1995

[54] ADJUSTABLE GOLF PUTTER

[75] Inventors: Charles H. Stubbs, Chamblee; Earl N. Choy, Cumming, both of Ga.

[73] Assignee: Tru-Line U.S.A., Inc., Alpharetta, Ga.

[21] Appl. No.: 149,363

[22] Filed: Nov. 9, 1993

[51] Int. Cl.[6] ..... A63B 53/02; A63B 53/06

[52] U.S. Cl. ..... 273/80.1; 273/79; 273/167 F; 273/162 R; 273/171

[58] Field of Search ..... 273/80.1, 80.2, 79, 273/168, 173, 81 R, 169, 167 F, 171, 172, 167 H, 167 R, 162 R, 193 R, 194 R, 194 A, 162 F, 32 B

[56] References Cited

U.S. PATENT DOCUMENTS

| | | | |
|---|---|---|---|
| 1,083,434 | 1/1914 | Curry . | |
| 1,206,104 | 11/1916 | Goodrich . | |
| 1,258,212 | 3/1918 | Goodrich . | |
| 1,610,802 | 12/1926 | McNair | 273/80.1 |
| 2,155,830 | 4/1939 | Howard | 273/79 |
| 2,520,702 | 9/1950 | Verderber . | |
| 2,932,515 | 4/1960 | May | 273/80.1 |
| 3,397,888 | 8/1968 | Springer | 273/80.7 |
| 4,736,951 | 4/1988 | Grant | 273/79 |
| 4,815,740 | 3/1989 | Williams | 273/80.2 |
| 4,878,666 | 11/1989 | Hosada . | |
| 5,127,653 | 7/1992 | Nelson | 273/167 C |
| 5,193,806 | 3/1993 | Burkly | 273/167 C |

FOREIGN PATENT DOCUMENTS

| | | | |
|---|---|---|---|
| 1232651 | 5/1971 | United Kingdom | 273/80.1 |
| WO9006157 | 6/1990 | WIPO | 273/80.1 |

*Primary Examiner*—Sebastiano Passaniti

*Attorney, Agent, or Firm*—Wigman, Cohen, Leitner & Myers

[57] ABSTRACT

A golf putter has a replaceable and adjustable club head connected to a shaft by a hosel member. The hosel member permits adjustment of the angle between the longitudinal axis of the club head and the axis of the shaft. This adjustment permits the putter to be configured as a right- or left-handed putter and also permits the lie angle of the club to be adjusted. The hosel member can be connected to the club head in a selected one of a plurality of positions along the longitudinal axis of the club head to adjust the position of the center of percussion or "sweet spot" of the club head.

18 Claims, 2 Drawing Sheets

ADJUSTABLE GOLF PUTTER

FIELD OF THE INVENTION

The present invention relates to golf clubs and more particularly to a golf putter having a club head which is replaceable and adjustable in a plurality of ways.

BACKGROUND OF THE INVENTION

There exists in the art a variety of golf clubs wherein the head is adjustable relative to the shaft. For example, U.S. Pat. Nos. 4,878,666 to Hosoda; 2,520,702 to Verderber; 1,258,212 to Goodrich; 1,206,104 to Goodrich; and 1,083,434 to Curry disclose golf clubs wherein the head is variable in its angle relative to the shaft. In particular, the club heads disclosed in the aforementioned patents rotate or pivot about a longitudinal axis extending through the club head from heel to toe. Such adjustment allows variance of the loft angle or "angle of approach" between the head and the golf ball which it strikes. This type of adjustment is particularly desirable for woods, irons, and other clubs used for golf shots in which the ball is lifted from the playing surface by the club. In the case of the aforementioned patents, the adjustable head also permits each club to be used as a putter as well as an iron of variable loft angle. In other words, the primary feature of these clubs is versatility for use off the green as well as on it. Thus, the adjustment for putting merely involves locating the striking face of the club in a substantially vertical plane.

In putting, however, there are considerations other than merely locating the plane of the putter striking face. For example, it would be desirable if the longitudinal axis of the putter head were positioned relative to the axis of the putter shaft at the optimum angle for the particular lie of the ball on the green, i.e., the "lie angle." Such adjustment is useful in putting balls lying on a variety of terrains and inclines. Heretofore, a player desiring to change the lie angle of the club head has sometimes resorted to measures as drastic as bending the club shaft. Another disadvantage of the above prior art adjustable clubs is that they are not convertible for use by both right- and left-handed players. It would be desirable, therefore, to provide a single golf putter which not only can be used by both right- and left-handed players, but also can accommodate various lie angles of the ball on the putting surface.

With golf clubs, and in particular putters, it would also be desirable to adjust the center of percussion of the club head, popularly referred to by golfers as the "sweet spot." The sweet spot is that point on the face of the head where contact with the ball results in the least amount of torque about the shaft. The location of the center of percussion or sweet spot is a function of the shape, size, and mass of the head, as well as the relative distance of the hosel from the toe and heel of the head. Thus, for example, moving the hosel closer to the toe moves the sweet spot in that same direction. Accordingly, it would be advantageous to have a putter wherein the sweet spot is adjustable along the longitudinal axis of the head between the heel and toe thereof.

It would also be desirable to provide a golf putter with a replaceable head. Some golfers carry several putters having differently designed club heads, e.g., different club head weights. With a replaceable head putter, only the different putter heads need be carried rather than several different complete putters.

SUMMARY OF THE INVENTION

The present invention is directed to a golf putter having a club head member which is advantageously replaceable as well as adjustable in three different ways. The golf putter comprises a shaft having a two-piece hosel member which is removably and adjustably affixed to the club head member by a threaded fastener in a selected one of a plurality of positions arranged in spaced relation along an axis parallel to the longitudinal axis of the head member. The head member is provided with an elongated slot or recess in the rear face thereof with at least three blind threaded bores to one of which the hosel member is fastened by the threaded fastener. Steel dowel pins are also provided between the hosel member and the head member for positively locating the hosel member relative to the head member. Locating and securing the two-piece hosel member in one of the spaced positions along the longitudinal axis of the head member establishes the center of percussion or sweet spot of the club head for that position. Each position will have a different center of percussion.

The two-piece hosel member provides means for two additional adjustments of the golf putter of the invention. The hosel member comprises a swing arm member and a block member pivotably related to one another by the threaded fastener which extends through aligned holes in the members. The arm member and block member are rotatably positionable relative to one another about the fastener axis into a plurality of fixed angular positions. The fixed angular positions are set by a dowel pin member fixed to the arm which is engagable in one of a plurality of blind bores in the block member. This arrangement permits the putter to be set for right- or left-handed use and also permits the angle of the longitudinal axis of the club head member to be adjusted relative to the axis of the shaft, i.e., lie angle adjustment.

The two-piece hosel member can be used to secure different club head member designs to the shaft when, for example, it is desired to use a heavier or lighter weight head or heads with different shapes or striking face configurations.

The club head member is advantageously made of an aluminum alloy, such as 6061 aluminum alloy, and may be provided with additional weights, such as brass bars, located in bores in the heel and toe of the head member. The arm and block members of the hosel member are also preferably made of brass.

With the foregoing and other objects, advantages and features of the invention that will become hereinafter apparent, the nature of the invention may be more clearly understood by reference to the following detailed description of the invention, the appended claims, and to the several views illustrated in the drawings.

DETAILED DESCRIPTION OF THE INVENTION

Figure 1:
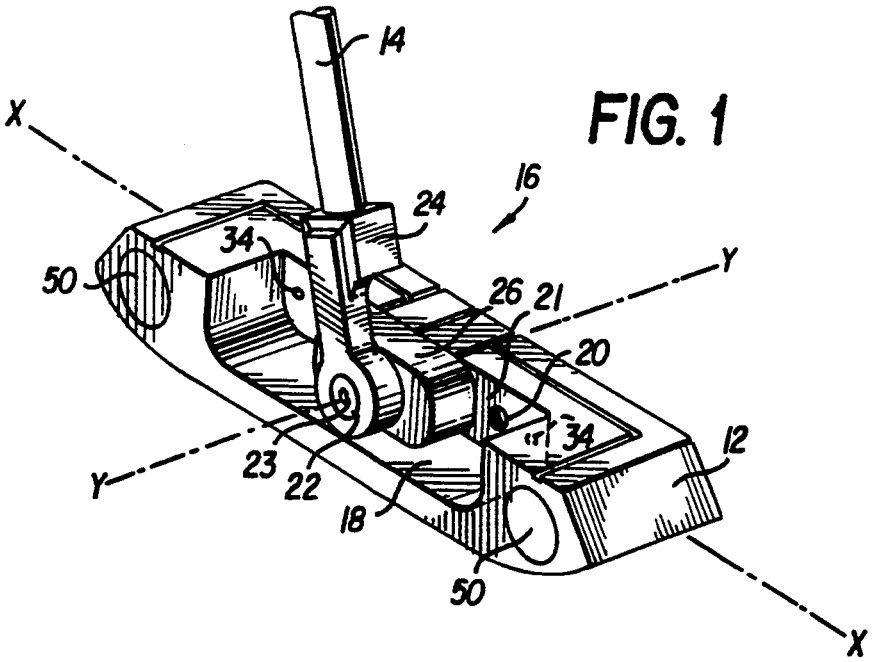
FIG. 1 is a perspective view of the golf putter of the present invention.

Referring now to the drawings, there is illustrated in FIGS. 1–6 a preferred embodiment of a golf putter of the present invention which is designated generally by reference numeral 10. Putter 10 generally comprises a club head member 12 removably mounted to a shaft 14 by a hosel member 16, the construction and functions of which are described more fully hereinbelow. Shaft 14 may be of any conventional construction and design. Club head 12 is provided with an L-shaped slot or recess 18 on the rearward side or face of the head. Three blind threaded bores 20 are located on the vertical surface 21 of the slot 18. Slot 18 comprises a pair of substantially planar surfaces disposed at right angles to one another. It will be understood that more than three threaded bores 20 may be provided.

Hosel member 16 comprises two main components, namely, a swing arm member 24 and a block or spacer member 26. Block member 26 has four substantially planar surfaces with a substantially rectangular cross-section, two of said planar surfaces being engageable with the pair of planar surfaces forming slot 18. The hosel components 24, 26 are connected to each other and to club head 12 by means of a threaded fastener 22, such as a 10-32 flat head screw, which passes through aligned holes 25, 27 in the arm and block members 24, 26, respectively, and is threaded into a desired one of the three threaded bores 20. Fastener 22 may have a hexagonal drive socket 23 for receiving a driving tool, such as an Allen wrench 28 or other suitable driving device.

Figure 2:
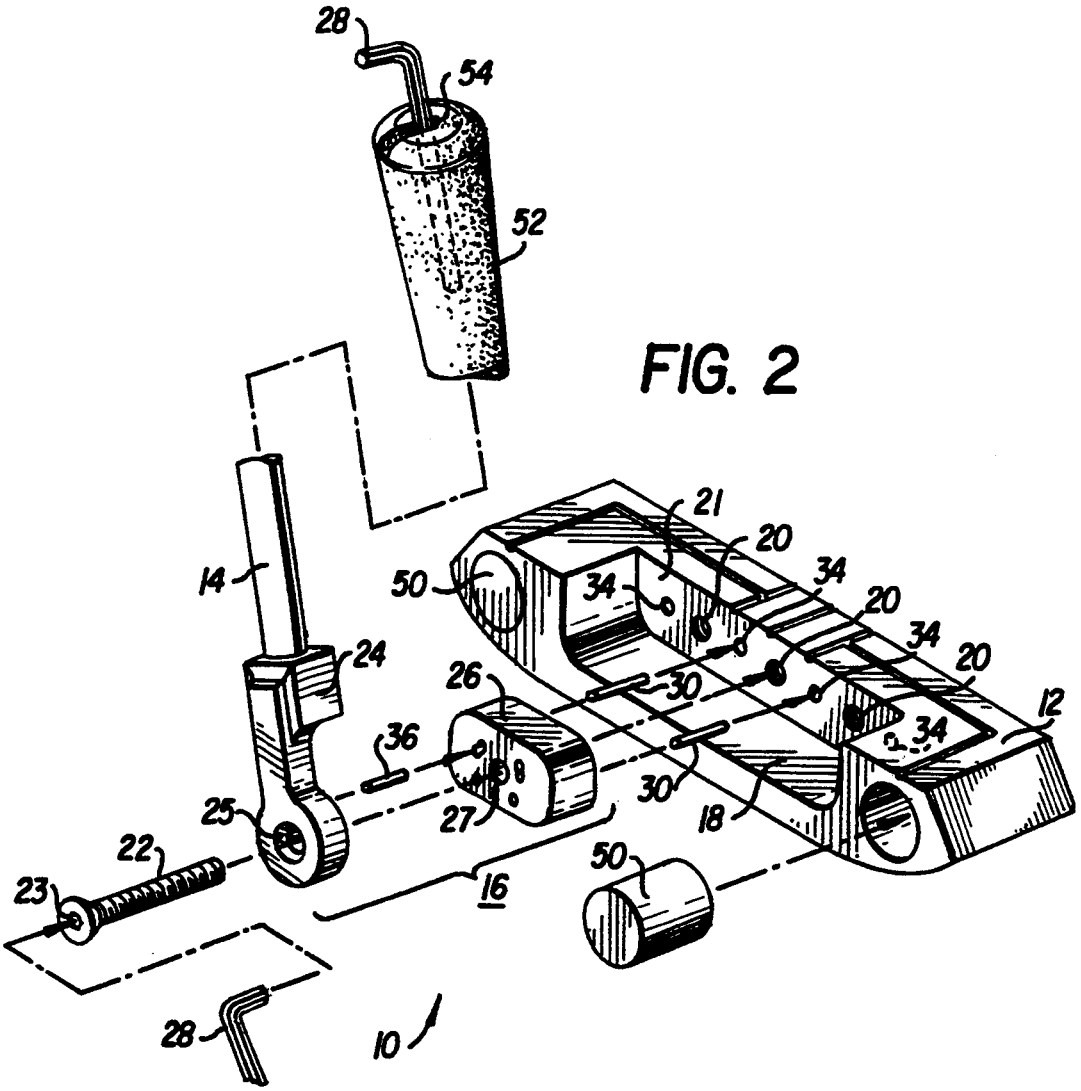
FIG. 2 is an exploded perspective view of the golf putter of FIG. 1 showing all the components thereof.
Figure 4:
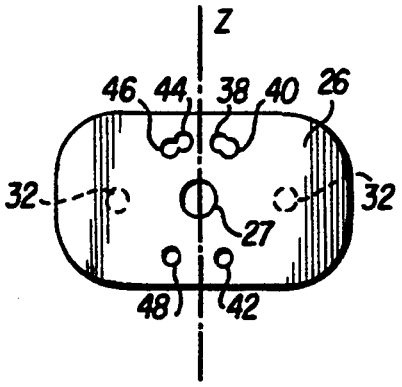
FIG. 4 is a side elevation view of the hosel block member of the golf putter of the present invention showing the locations of the bores for adjusting the club head lie angle and the right- and left-handed positions of the putter.
Figure 5:
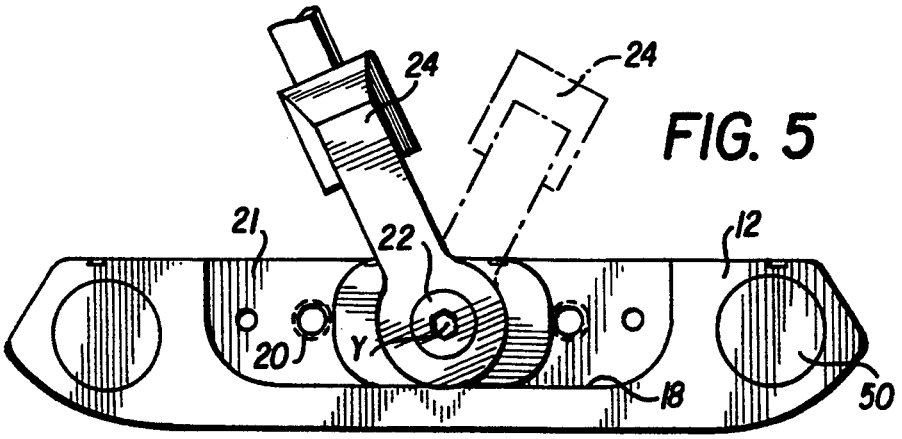
FIG. 5 is a side elevation view of the putter head shown with the hosel unit mounted in right- and left-handed positions.

Referring to FIGS. 2 and 4, it will be seen that the block member 26 is pinned to the club head 12 by means of a pair of stainless steel dowel pins 30 which are press fitted into blind bores 32 (shown in dashed lines in FIG. 4) on one face of block member 26. Pins 30 are sufficiently long to protrude from the block member 26 and engage with a slip fit into correspondingly spaced blind bores 34 on the vertical surface 21 of the club head 12.

It is preferred that the pins 30 be securely press fit into bores 32 in block member 26 so that they do not become lost or misplaced during adjustment of the club head. Accordingly, the spacing between the bores 34 in club head 12 must be machined with precision to match the spacing between the pins 30.

Figure 3:
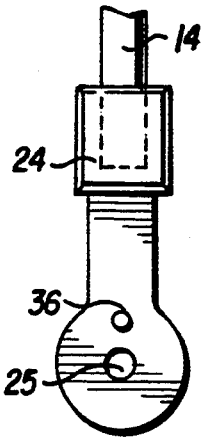
FIG. 3 is a side elevation view of the hosel arm member of the golf putter of the present invention showing the location of the fixed dowel pin.

Now referring to FIGS. 2–4, another stainless steel dowel pin 36 is press fitted into a blind bore in the arm member (FIG. 3) and is receivable in one of several blind bores 38, 40, 42 and 44, 46, 48 on the side of block member 26 opposite the side in which bores 32 are located. The shaft 14 may be rotated about the Y-axis so as to position the pin 36 with a slip fit into one of the bores 38, 40, 44 or 46. To position the pin 36 in one of the bores 42, 48, the block member 26 is removed from the slot 18 and inverted top to bottom to position the bores 42, 48 above the bores 38, 40 and 44, 46 respectively. This arrangement of the bores 38–48 permits a first adjustment possibility, that is, the putter may be configured as a right-handed putter with the pin 36 in one of the bores 44, 46 or bore 42 (with the block member 26 inverted) in the solid line position shown in FIG. 5 or as a left-handed putter with the pin 36 in one of the bores 38, 40 or bore 48 (block member 26 inverted) in the phantom line position shown in FIG. 5.

The bores 38 and 44 are located at an angle of about 15°, for example, from the vertical plane Z through the block member 26 (FIG. 4). Bores 40, 46 are located at an angle of about 25°, for example, from the vertical plane Z and bores 42, 48 are located at an angle of about 20°, for example, from the vertical plane Z. Thus, a second adjustment possibility exists. For either a right- or left-handed putter, the axis of shaft 14 may be angularly positioned at 15°, 20° or 25° from the vertical which corresponds to angles of 75°, 70° and 65° between the shaft axis and the longitudinal axis X of the club head.

This adjustment permits the lie angle to be varied. The above angles are only representative of the number and magnitude of the lie angles that may be used with the present invention. Additional block members having bores arranged at different lie angles may also be used. Other variations are also possible. For example, pins 30 may be press fitted into each of the bores 34 in the club head 12 and the bores 32 in the block member 26 may be through bores so that the block member may be inverted face-to-face. Bores for the pin 36 could then be provided on both faces of the block member 26 at various angles other than those described above. Other similar modifications will be apparent to those skilled in the art.

Figure 6:
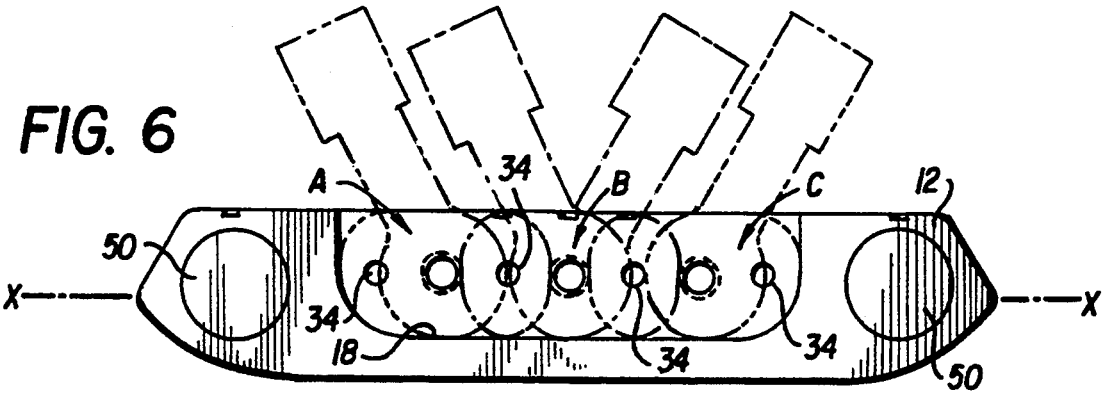
FIG. 6 is a side elevation view of the putter head of the present invention showing three possible positions of the hosel for adjusting the center of percussion of the club head.

Referring now to FIGS. 2 and 6, a third adjustment possibility is shown in which the hosel member 16 may be secured to the club head at one of three positions A, B or C by engaging the pins 30 into the appropriate pair of bores 34 and threading the fastener 22 into the appropriate threaded bore 20 located between the selected pair of bores 34. Typically, positions A and B would be used for a right-handed putter and positions B and C would be used for a left-handed putter. This adjustment shifts the "sweet spot" or center of percussion of the club head.

Club head 12 is preferably constructed of a 6061 aluminum alloy with a hard black anodized finish and has the approximate dimensions of 1 inch height, 1.25 inch width and 5 inch length. The lower corners are rounded and the upper corners are beveled at about a 30° angle. Head 12 is longitudinally symmetrical (i.e., the toe and heel have the same shape) thereby allowing putter 10 to be reversably used by either right- or left-handed players. Brass weights 50 may be press fitted into bores provided in the toe and heel of the head 12 to add weight to the head. The slot or recess 18 is about 2.75 inches long with a vertical wall about 0.75 inch in height and a depth of about 0.625 inches. As shown in FIG. 2, the handle 52 of club 10 may have an aperture 54 therein for carrying and storing Allen wrench 28 for easy access by the golfer.

Although only preferred embodiments are specifically illustrated and described herein, it will be appreciated that many modifications and variations of the present invention are possible in light of the above teachings and within the purview of the appended claims without departing from the spirit and intended scope of the invention.

We claim:

1. A golf putter comprising a club head having a longitudinal axis and a rearward face having a planar mounting surface, a shaft having a shaft axis and a hosel member connecting said club head to said shaft on a pivot axis, means for adjusting the angle between the shaft axis and the longitudinal axis of the club head about said pivot axis and means for shifting said pivot axis into a plurality of positions along the longitudinal axis of the club head, said angle adjusting means including said hosel member, said hosel member comprising a swing arm member mounted for relative rotation about said pivot axis and a block member mounted between said planar mounting surface and said swing arm member, said swing arm member being angularly positionable relative to said block member into a plurality of fixed positions, and said block member having a planar surface engagable with said planar mounting surface at said plurality of positions along the longitudinal axis of the club head.

2. The golf putter of claim 1, wherein said club head is made of aluminum alloy and said hosel member is made of brass.

3. The golf putter of claim 1, wherein said club head comprises heel and toe portions, a slot formed in said club head between said heel and toe portions, said adjusting means and said shifting means being mounted in said slot.

4. The golf putter of claim 3, including weights mounted in bores in said heel and toe portions.

5. A golf putter comprising a club head having a longitudinal axis, a shaft having a shaft axis and a hosel member connecting said club head to said shaft on a pivot axis, means for adjusting the angle between the shaft axis and the longitudinal axis of the club head about said pivot axis and means for shifting said pivot axis into a plurality of positions along the longitudinal axis of the club head, said angle adjusting means including said hosel member, said hosel member comprising a block member and swing arm member mounted for relative rotation about said pivot axis, said swing arm member being angularly positionable relative to said block member into a plurality of fixed positions, said shifting means comprising a plurality of threaded bores on said club head arranged parallel to said longitudinal axis and a threaded fastener passing through said hosel member along said pivot axis and adapted to be threaded into a selected one of said threaded bores.

6. The golf putter of claim 5, including a first pin member mounted to said arm member, said block member having a plurality of first bores into one of which said first pin member is selectively positionable.

7. The golf putter of claim 6, further including a pair of second pin members mounted to said block member, said club head having a plurality of second bores into a pair of which said pair of second pin members is selectively positionable.

8. The golf putter of claim 6, wherein said plurality of first bores comprises pairs of first bores positioned at equal angles on either side of a plane passing through the block member along the pivot axis.

9. The golf putter of claim 8, wherein said first bore pairs are positioned at angles of about 15°, 20° and 25° relative to said plane.

10. The golf putter of claim 5, wherein said shaft has a handle and means on said handle for storing a driving tool for said fastener.

11. The golf putter of claim 7, wherein said first pin member is press fitted into a bore in said arm member and said second pin members are press fitted into a pair of bores in said block member.

12. The golf putter of claim 5, wherein said arm member and said block member are each provided with a through hole, said threaded fastener extending through said through holes into one of said threaded bores in the club head.

13. A golf putter comprising a club head having a longitudinal axis, a shaft having a shaft axis and a hosel member connecting said shaft to said club head and including:

means for adjusting the angle between the shaft axis and the longitudinal axis of the club head about a pivot axis whereby the lie angle is adjustable and the putter is adapted for left- or right-handed use, said angle adjusting means including said hosel member, said hosel member comprising a block member and a swing arm member mounted for relative rotation about said pivot axis, said arm member being angularly positionable relative to said block member into a plurality of fixed positions; and means for shifting said pivot axis into a plurality of different positions along the longitudinal axis of the club head whereby the center of percussion of the club head is adjustable, said shifting means comprising a plurality of threaded bores on said club head arranged parallel to said longitudinal axis, and a threaded fastener passing through said hosel member along said pivot axis and adapted to be threaded into a selected one of said threaded bores.

14. The golf putter of claim 13, including a first pin member mounted to said arm member, said block member having a plurality of first bores into one of which said first pin member is selectively positionable and further including a pair of second pin members mounted to said block member, said club head having a plurality of second bores into a pair of which said pair of second pin members is selectively positionable.

15. The golf putter of claim 14, wherein said plurality of first bores comprises pairs of first bores positioned at equal angles on either side of a plane passing through the block member along the pivot axis, said plurality of second bores being arranged along a line parallel to said longitudinal axis.

16. The golf putter of claim 13, wherein said club head has a heel and toe and is made of an aluminum alloy, weights mounted in the heel and toe of said club head, and including means mounted on said golf putter for supporting a driving tool for said threaded fastener.

17. A golf putter comprising a club head having a longitudinal axis, a shaft having a shaft axis and a hosel member connecting said club head to said shaft on a pivot axis, said hosel member comprising a swing arm member mounted to said club head for relative rotation about said pivot axis into a plurality of fixed angular positions relative to the longitudinal axis of the club head, a block member interposed between said swing arm member and said club head, said block member being mountable to said club head into a plurality of fixed positions along the longitudinal axis of said club head, said block member and club head each having a pair of substantially planar surfaces disposed at right angles to one another, each of the planar surfaces of said pair of planar surfaces of said block member being engagable with a respective planar surface of said pair of planar surfaces of said club head.

18. The golf putter of claim 17, wherein said pair of planar surfaces of said club head comprises an L-shaped slot in a rear surface of said club head, said block member comprising four surfaces having a substantially rectangular cross-section, two of said four surfaces comprising said pair of planar surfaces of said block member.

* * * * *